US006330340B1

(12) United States Patent
Proni

(10) Patent No.: US 6,330,340 B1
(45) Date of Patent: Dec. 11, 2001

(54) LOUDSPEAKER WITH A DIAPHRAGM HAVING INTEGRAL VENT BORES

(75) Inventor: Lucio Proni, Weston, FL (US)

(73) Assignee: JL Audio, Inc., Miramar, FL (US)

( * ) Notice: Subject to any disclaimer, the term of this patent is extended or adjusted under 35 U.S.C. 154(b) by 0 days.

(21) Appl. No.: 09/651,369

(22) Filed: Aug. 30, 2000

Related U.S. Application Data

(63) Continuation-in-part of application No. 08/964,095, filed on Nov. 4, 1997, now Pat. No. 6,118,884, which is a continuation-in-part of application No. 08/580,764, filed on Dec. 29, 1995, now Pat. No. 5,734,734.

(51) Int. Cl.[7] ..... H04R 25/00

(52) U.S. Cl. ..... 381/397; 381/423; 381/432; 381/424

(58) Field of Search ..... 381/423, 424, 381/432, 397, 398; 181/173

(56) References Cited

U.S. PATENT DOCUMENTS

| | | | |
|---|---|---|---|
| 1,759,725 | 5/1930 | Young et al. . | |
| 1,869,665 | 8/1932 | Chann . | |
| 1,915,217 | 6/1933 | Crosley, Jr. . | |
| 2,038,401 | 4/1936 | Wunderlich | 179/115.5 |
| 2,261,110 | 11/1941 | Engholm | 179/115.5 |
| 2,261,111 | 11/1941 | Engholm | 179/115.5 |
| 2,295,483 | 9/1942 | Knowles | 179/115.5 |
| 2,429,470 | 10/1947 | Knowles | 179/115.5 |
| 2,775,309 | 12/1956 | Willchur | 181/31 |
| 2,858,377 | 10/1958 | Levy | 179/115.5 |
| 3,328,537 | 6/1967 | Hecht | 179/115.5 |
| 3,991,286 | 11/1976 | Henricksen | 179/115.5 H |
| 4,158,756 | 6/1979 | Keezer | 179/115.5 R |
| 4,210,778 | 7/1980 | Sakurai et al. | 179/1 E |
| 4,313,040 | 1/1982 | Tsukamoto | 179/115.5 R |
| 4,387,275 | 6/1983 | Shimada et al. | 179/115.5 R |
| 4,418,247 | 11/1983 | Hansen | 179/115.5 R |
| 4,433,214 | 2/1984 | Jasinski | 179/115.5 ES |
| 4,438,297 | 3/1984 | Kawamura | 179/117 |
| 4,547,632 | 10/1985 | Bryson | 179/115.5 VC |
| 4,577,069 | 3/1986 | Keezer | 179/119 R |
| 4,590,332 | 5/1986 | Delbuck | 179/115.5 PS |
| 4,821,331 | 4/1989 | Murayama et al. | 381/192 |
| 4,933,975 | 6/1990 | Button | 381/192 |
| 5,042,072 | 8/1991 | Button | 381/192 |
| 5,081,684 | 1/1992 | House | 381/199 |
| 5,357,586 | 10/1994 | Nordschow et al. | 381/199 |
| 5,426,707 | 6/1995 | Wijnker | 381/194 |
| 5,430,804 | 7/1995 | Wijnker | 381/194 |
| 5,909,015 | 6/1999 | Yamamoto et al. | 181/156 |
| 5,940,522 | 8/1999 | Cahill et al. | 381/397 |

FOREIGN PATENT DOCUMENTS

| | | |
|---|---|---|
| 900 227 | 12/1953 | (DE) . |
| 724113 | 3/1952 | (GB) . |
| 3-239099 | 10/1991 | (JP) . |

*Primary Examiner*—Sinh Tran
(74) *Attorney, Agent, or Firm*—Holland & Knight LLP

(57) ABSTRACT

A loudspeaker is provided including a diaphragm having a lower end formed with an inner surface mounted to the voice coil former, an outer surface spaced from the inner surface and a number of circumferentially-spaced vent bores formed between the inner and outer surfaces which vent a dust cap cavity. Alternatively, the lower end of the diaphragm is mounted to the outer surface of the voice coil in position so that a deflector formed in such lower end is located in the path of a flow of air entering and leaving the dust cap cavity through vent bores formed in the voice coil former to direct such air flow over the wire winding of the voice coil and obtain at least some cooling thereof in addition to venting the dust cap cavity.

10 Claims, 9 Drawing Sheets

LOUDSPEAKER WITH A DIAPHRAGM HAVING INTEGRAL VENT BORES

This application is a continuation-in-part of U.S. application Ser. No. 08/964,095 filed Nov. 4, 1997 entitled AUDIO VOICE COIL ADAPTOR RING, now U.S. Pat. No. 6,118,884 which is a continuation-in-part of U.S. application Ser. No. 08/580,764, filed Dec. 29, 1995 entitled AUDIO VOICE COIL ADAPTOR RING, now U.S. Pat. No. 5,734,734.

FIELD OF THE INVENTION

This invention relates to loudspeakers, and, more particularly, to a loudspeaker having a diaphragm formed with vent bores, or, alternatively, a diaphragm with a deflector aligned with bores formed in the voice coil of the loudspeaker, for venting air from the dust cap cavity located between the voice coil and the dust cap or diaphragm preferably along a flow path which is in thermal communication with the voice coil.

BACKGROUND OF THE INVENTION

Loudspeakers generally comprise a frame, a motor structure, a diaphragm, a lower suspension or spider and an upper suspension or surround. In one common type of speaker, the motor structure includes a permanent magnet mounted between a top plate and a back plate, a pole piece centrally mounted on the back plate and a voice coil axially movable with respect to the pole piece. The voice coil includes a hollow, cylindrical-shaped former having an outer surface which receives a winding of wire. In some designs, the former is formed with a number of circumferentially-spaced bores at a location spaced from where the wire winding is located.

One end of the diaphragm is connected to the surround which, in turn, is mounted to the upper end of the frame. The spider is connected at one end to a seat formed in the frame at a point between its upper and lower ends. The free ends of the diaphragm and spider are mounted to the voice coil and support it within the magnetic gap formed between the pole piece and top plate of the motor structure, with the former of the voice coil concentrically disposed about the pole piece. In some speaker designs, a dust cap is mounted to the diaphragm in position to overlie the voice coil and pole piece to protect them from contaminants. This forms a dust cap cavity between the dust cap, diaphragm and the voice coil and pole piece. In alternative designs, the upper end of the voice coil is connected directly to the diaphragm, thus eliminating the need for a dust cap but nevertheless forming an internal or dust cap cavity in the area directly above the voice coil and pole piece.

In the course of operation of a speaker of the type described above, electrical energy is supplied to the voice coil causing it to axially move relative to the pole piece and within the air gap formed between the top plate and pole piece. The diaphragm, spider and surround, move with the excursion of the voice coil.

Often a loudspeaker design can be best optimized by utilizing a voice coil with a small diameter. However, the smaller voice coil setup creates certain problems, especially when designing loudspeakers for low frequency reproduction. Thus, for larger diameter loudspeakers (typically 10 inches and above), small voice coil systems are not common. Accordingly, there are few, if any, existing diaphragms tooled for the smaller diameter voice coil formers. To incorporate a small voice coil system, the diaphragm must be customized, adapted or re-tooled.

One disadvantage of mating a diaphragm directly to a smaller voice coil is that a relatively small adhesive joint is made. Since the voice coil's diameter is much smaller, the gluing circumference is drastically reduced. Therefore, the designer must be concerned with the possibility of mechanical failures since the stress distribution around the glue joint is high. Because the spider attaches at this critical junction as well, spider joint stress also increases, introducing yet another possible failure mode.

Another problem associated with smaller voice coils occurs in the use of pole vents. Pole vents comprise holes bored directly through the pole piece within the motor structure. These vents are used to relieve air pressure that builds up within the dust cap cavity. Without a pole vent, audible noise can be introduced as the trapped air tries to escape during large cone excursions. However, when using a small diameter voice coil, the amount of metal in the pole piece is very limited. Such amount of steel can only support a limited amount of magnetic flux. Consequently, using a pole piece with large amounts of metal removed for pole vents can radically alter the performance of the magnetic circuit.

A vented pole piece further affects the thermal behavior of the speaker. The steel contained in the pole piece provides an effective thermal sink for the voice coil. Machining a pole vent in the pole piece increases thermal resistance of the sink, lowering the power handling capability of the loudspeaker.

The mechanical integrity of the spider is also compromised when using a small voice coil. Spiders are typically made from resin treated cloth materials. When the inner diameter of the spider gets smaller, fewer strands of material intersect the cutout. Since the glue joint lies on this small circumference, very little spider material is captured. This places the spider material under greater stress than normal which can cause it to fatigue prematurely.

Several loudspeaker designs are contemplated in the background art for improving speaker performance, stabilizing the speaker diaphragm, and/or simplifying the manufacturing process. However, none of these references solve the above-noted problems. For example, Mitobe (U.S. Pat, No. 5,111,510) discloses a speaker and manufacturing method therefor including a diaphragm integrally combined with a first frame piece and a driver unit integrally combined with a second frame piece. Saiki et al. (U.S. Pat. No. 5,371,805) discloses a speaker and speaker system employing the same, comprising a diaphragm secured to a first periphery of an edge member and a frame secured to a second periphery of the edge member. Scholz (U.S. Pat. No. 5,323,469) discloses a conical loudspeaker having a conical stabilizing element joined between an underside of a speaker membrane and an outside surface of a speaker moving coil carrier. Kreitmeier (U.S. Pat. No. 5,424,496) discloses an electromagnetic converter comprising an internal magnet system, a moving coil and tubular segment. Kreitmeier (U.S. Pat. No. 4,764,968) discloses a disk-like diaphragm made from a conical plastic film and provided with vacuum formed support members which extend up to the disk-like radiating layer. Finally, Kobayashi (U.S. Pat. No. 4,118,605) discloses a coil mount structure comprising a cylindrical member, around one end portion of which a diaphragm edge is fixed, an inner peripheral edge portion where a damper is removably fixed, and an opposite end portion around which a coil is provided. Kobayashi, however, does not provide any structure for ventilating air pressure from beneath the dust cap cavity.

SUMMARY OF THE INVENTION

It is therefore among the objectives of this invention to provide a loudspeaker in which a secure connection is obtained between the voice coil former, spider and diaphragm, which provides venting of the dust cap cavity and which provides at least some cooling of the wire winding of the voice coil.

According to these and other objects, one embodiment of this invention comprises an adaptor ring and a loudspeaker with a voice coil that incorporates the adaptor ring. The loudspeaker comprises a frame, a diaphragm, a dust cap, a surround or upper suspension mounted to the frame and supporting the diaphragm's upper end, a voice coil including a cylindrical-shaped former having an outer surface carrying a wire winding and being mounted to the adaptor, a lower suspension or spider connected at one end to the frame and at the other end to the adaptor ring for centering the voice coil system, and, a magnetic circuit including a top plate, a back plate, a pole piece mounted to the back plate and a permanent magnet mounted between the top plate and back plate.

In one presently preferred embodiment, the adaptor ring comprises a substantially cylindrical-shaped sleeve which mounts to the outer surface of the voice coil former. The adaptor ring includes at least one ledge around its lower peripheral edge having sufficient surface area for receiving, supporting and adhering the diaphragm and spider. Accordingly, the ledge is also referenced as a spider plateau since it provides a horizontal platform for supporting the spider. The spider plateau stabilizes and increases the structural integrity of the diaphragm for minimizing deflection and providing an overall improved performance and strength. This plateau/edge provides a larger surface area for adhering the spider which is superior to gluing it directly to the vertical wall of the voice coil former, as shown, for example, in U.S. Pat. No. 4,764,968. By providing a substantially horizontal plateau for securing the spider, adhesives may be applied to both the upper and lower sides of the spider to increase the adhesive contact area. The extra adhesive contact area defined by the plateau provides for a strengthened spider attachment so as to greatly reduce the possibility of failure.

The plateau also benefits the diaphragm in that it provides a mechanical stop for receiving the cone's lower edge and adhering it to the adaptor. This enhances the joint between the cone and adaptor for increased reliability and reduced likelihood of failure. If the diaphragm is attached to the top of the spider, the spider can be completely locked and secured in place so as to virtually eliminate this joint as a possible failure point in the loudspeaker. A substantial decrease in stress on the glue joints is realized by the structure and method of the instant invention. In short, there is better stress distribution across the joint and increased stability provided by the spider plateau.

The adaptor ring of the instant invention further comprises venting passages vertically bored through the wall of the adaptor ring from top to bottom for releasing air pressure build up in the volume within the dust cap cavity. These venting passages eliminate the need for providing a pole vent in the pole piece. Eliminating the pole vent reduces manufacturing time and costs. A solid pole piece also offers an increase in magnetic circuit efficiency as well as a less resistant thermal path for heat transfer from the voice coil. An improvement in the heat transfer from the voice coil increases the power rating of the driver making the speaker more reliable. It has been determined that when a fairly porous spider is paired with the venting passages, air may exit noiselessly from the cone volume.

The adaptor ring of the instant invention defines an inner diameter adapted to receive the voice coil former for mounting the adaptor ring on the speaker. Accordingly, the cylinder is dimensioned to correspond to the voice coil former. An inner glue flange may be defined along the inner wall and floor of the adaptor ring. When the adaptor ring is installed over the voice coil former an inherent gap remains between the interior wall of the ring and the voice coil former. This gap is filled with glue to adhere the adaptor ring to the voice coil former. In the alternative, the voice coil former may have a stop projecting from the former for locking the adaptor ring place.

The spider plateau of the adaptor ring may also include at least one wire channel, or slots in the inner glue flange along its circumferential edge, to form channels when the adaptor is mounted to the former for running speaker wires, such as the lead out wire. In the alternative, the wire may be passed through one of the venting passages. The ring may also include a textured or ribbed surface for increased surface tension when applying adhesives.

In alternative embodiments of this invention, the adaptor ring is eliminated and its functionality is replaced by structure formed on the lower end of the diaphragm or cone. One series of embodiments include a diaphragm having a lower end formed with an inner surface mounted to the voice coil former, an outer surface spaced from the inner surface and a number of circumferentially-spaced vent bores formed between the inner and outer surfaces which vent the dust cap cavity. The lower end of the diaphragm in these embodiments is formed with a plateau or seat which mounts one end of the spider.

Further embodiments of this invention also eliminate the adaptor ring, but are intended for use with a voice coil former having a number of circumferentially-spaced vent bores. In these embodiments, the lower end of the diaphragm is mounted to the outer surface of the voice coil in position so that a deflector formed in such lower end is located in the path of a flow of air entering and leaving the dust cap cavity through the vent bores in the voice coil former. The deflector is oriented to direct such air flow over the wire winding of the voice coil to obtain at least some cooling thereof in addition to venting the dust cap cavity.

One advantage of eliminating the adaptor ring is the reduction in mass associated with the moving voice coil. This is especially helpful for midrange speakers and small midbass woofers which are negatively affected by too much mass. Additionally, the integral nature of the venting bores and spider mounting structure provided by the diaphragm of this invention helps ensure proper alignment within the finished loudspeaker. This is important in smaller speakers where the magnetic gap in the motor structure is relatively tight.

DESCRIPTION OF THE DRAWINGS

The structure, operation and advantages of the presently preferred embodiments of this invention will become further apparent upon consideration of the following description, taken in conjunction with the accompanying drawings, wherein.

DESCRIPTION OF THE PREFERRED EMBODIMENTS

Figure 1:
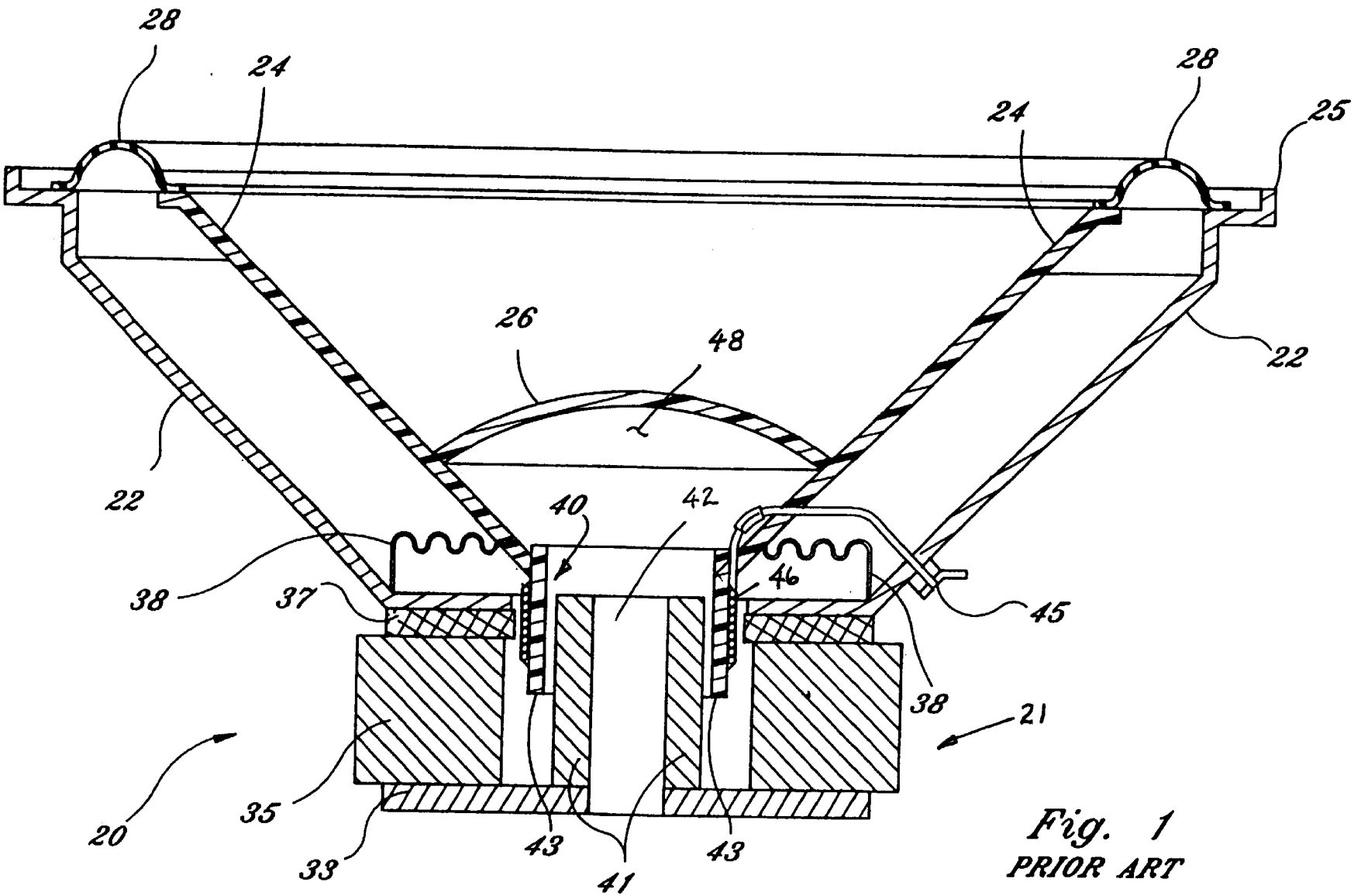
Fig. 1 PRIOR ART
FIG. 1 is a cross-sectional view of the prior art loudspeaker.

Referring now to the drawings, the elements of a conventional loudspeaker are discussed initially with reference to FIG. 1 labeled "Prior Art." Many of the same elements depicted in FIG. 1 are included in the various embodiments of the loudspeaker of this invention, and therefore the same reference numbers are used in FIGS. 2–17 to denote structure common to that of FIG. 1.

Figures 10, 11:
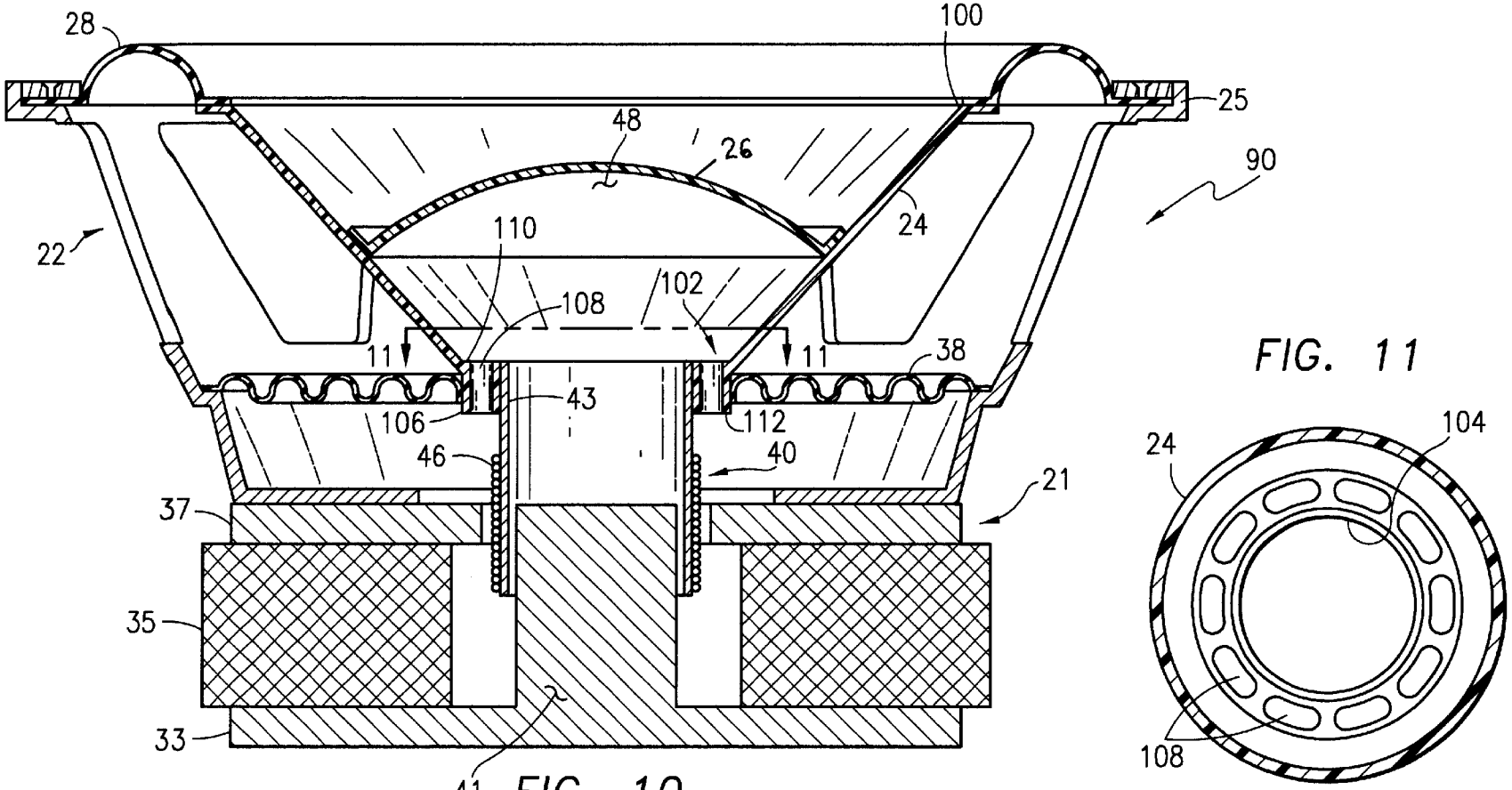
FIG. 10 is a cross sectional view of a loudspeaker including an alternative embodiment of this invention.
FIG. 11 is a view taken generally along line 11—11 of FIG. 10.
Figure 15:
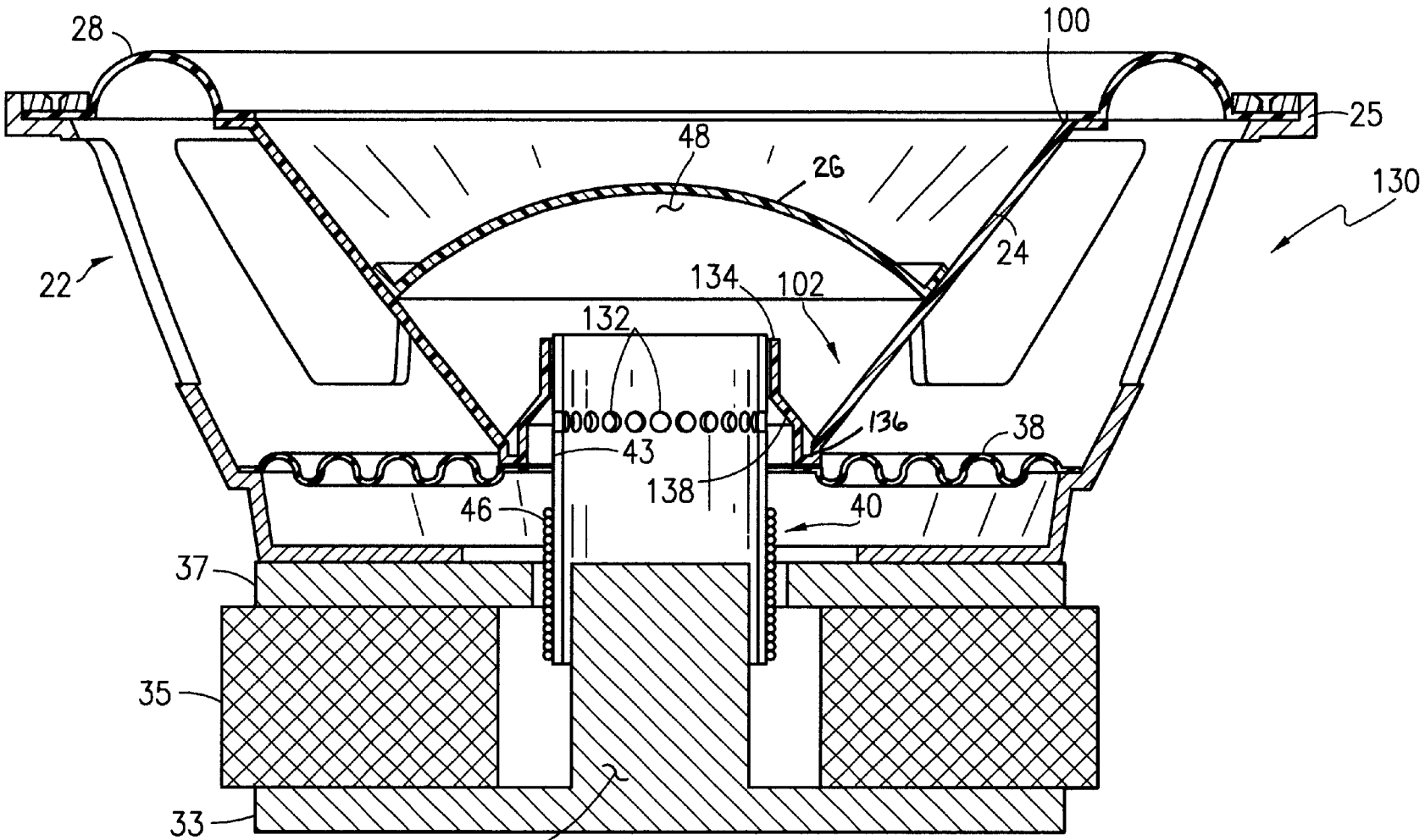
FIG. 15 is a cross sectional view of a loudspeaker including another embodiment of this invention.

The loudspeaker 20 shown in FIG. 1 generally comprises a motor structure 21, a frame 22 mounted to the motor structure 21, a cone or diaphragm 24, a lower suspension or spider 38 and an upper suspension or surround 28. Conventionally, the motor structure 21 includes a top plate 37 and a back plate 33 which are spaced from one another and mount a permanent magnet 35 therebetween. A pole piece 41 is connected to and extends upwardly from the back plate 33 into a central bore formed in both the magnet 35 and top plate 37. The pole piece 41 may be formed with a central bore 42 as depicted in FIG. 1, or it may be solid as shown in FIGS. 10 and 15. A magnetic gap is formed between the top plate 37 and the pole piece 41, as shown. A voice coil 40 is also provided which includes a hollow, cylindrical-shaped former 43, having an inner surface and an outer surface which receives a wire winding 46. The former 43 is concentrically disposed about the pole piece 41, and the voice coil 40 is axially movable within the magnetic gap during operation of the speaker 20.

Figure 1A:
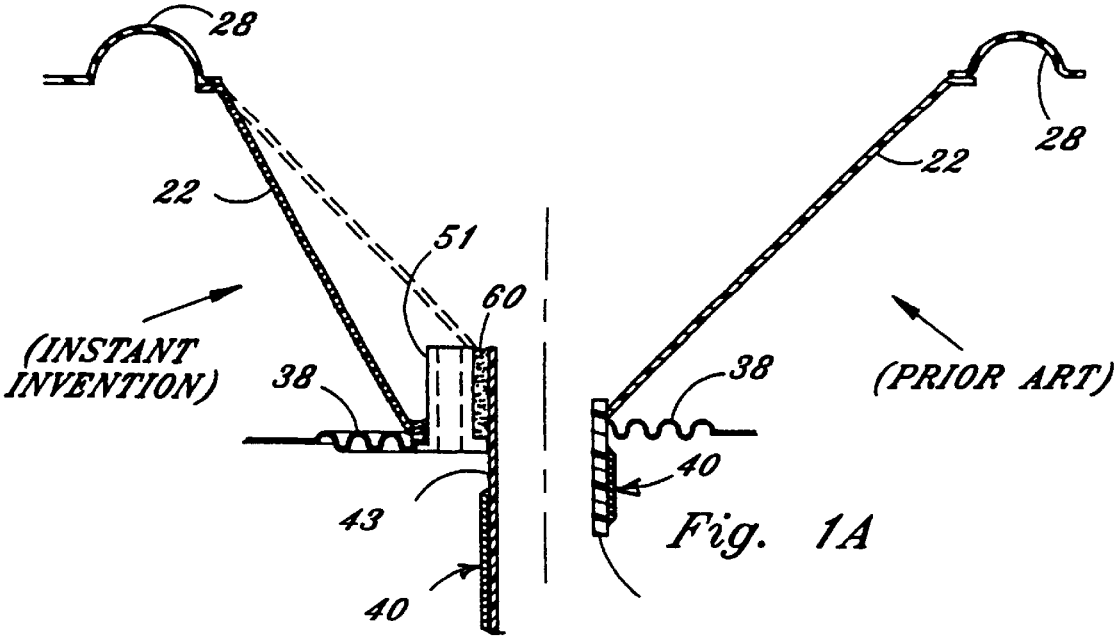
FIG. 1A is an illustration of the cone angle increase when incorporating the instant invention.

The voice coil 40 is held in place with respect to the pole piece 41 by the diaphragm 24, spider 38 and surround 20. The lower end of the diaphragm 24 is affixed to the former 43 of the voice coil 40 by adhesive or the like, and its opposite upper end connects to the surround 28. The surround 28, in turn, is mounted to the upper end 25 of the frame 22 as shown. The diaphragm 24 and surround 28 collectively provide support for the voice coil 40, in addition to the lower suspension or spider 38. One end of the spider 38 connects to the voice coil former 43, and its opposite end mounts to the frame 22. See FIGS. 1 and 1A.

A dust cap 26 is mounted to the diaphragm 24 in position to overlie the voice coil 40 and pole piece 41 in order to protect such elements from dirt, dust and other contaminants. A dust cap cavity 48 is therefore formed in the area defined by the lower portion of the diaphragm 24, the dust cap 26, the voice coil 40 and the pole piece 41. In response to the input of electrical energy to the wire winding 46, the voice coil 40 is moved axially with respect to the fixed motor structure 21. Because the diaphragm 24, spider 38, surround 28 and dust cap 26 are operatively connected to the former 43, such elements also move with the excursion of the voice coil 40. A "pumping" action is created as a result of axial movement of the diaphragm 24 and dust cap 26, which creates a flow of air into and out of the cavity 48.

Figure 4:
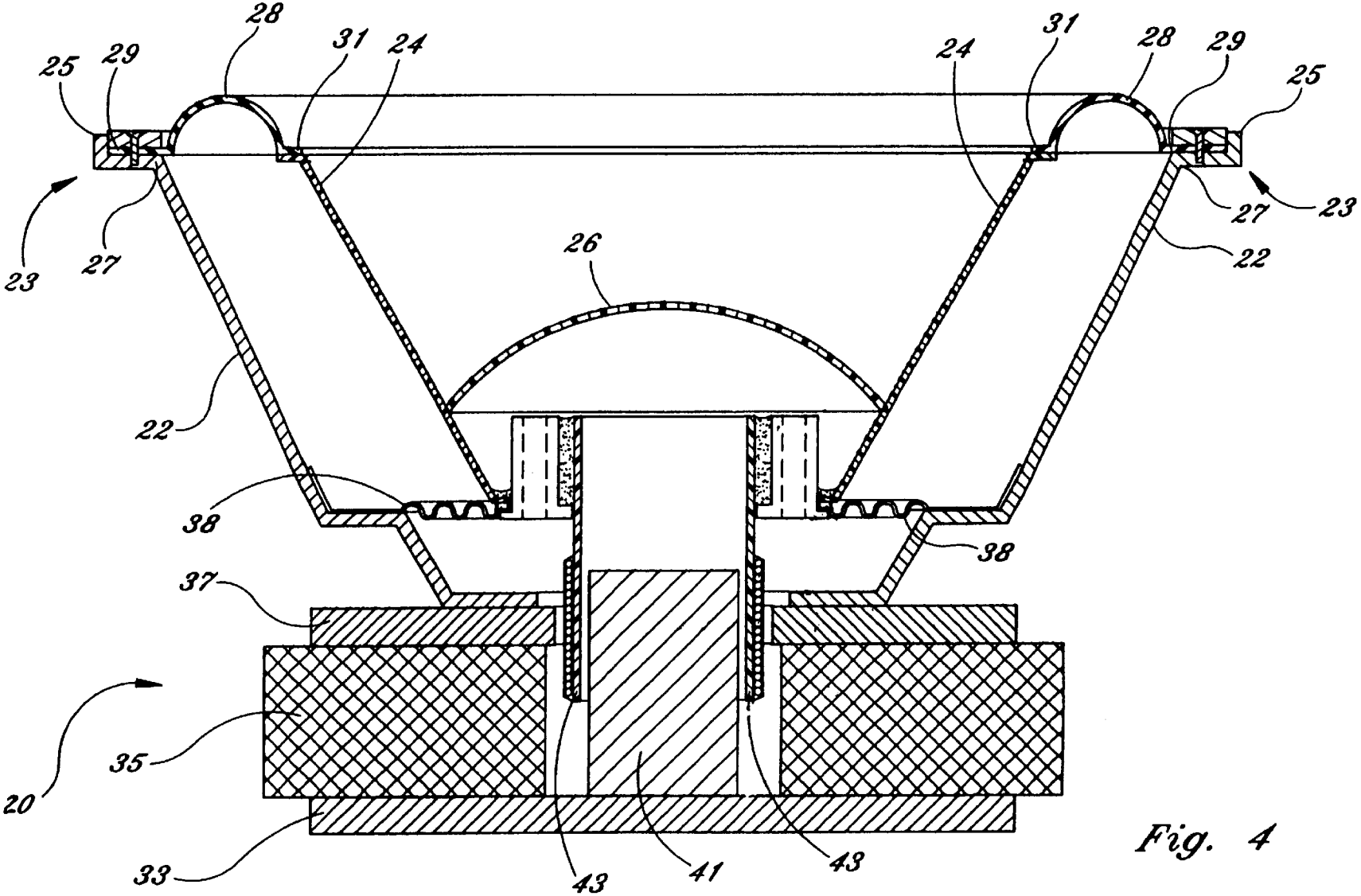
FIG. 4 is a cross-sectional view of the preferred embodiment of the loudspeaker and voice coil adaptor ring of the instant invention, as installed in the loudspeaker.
Figure 5:
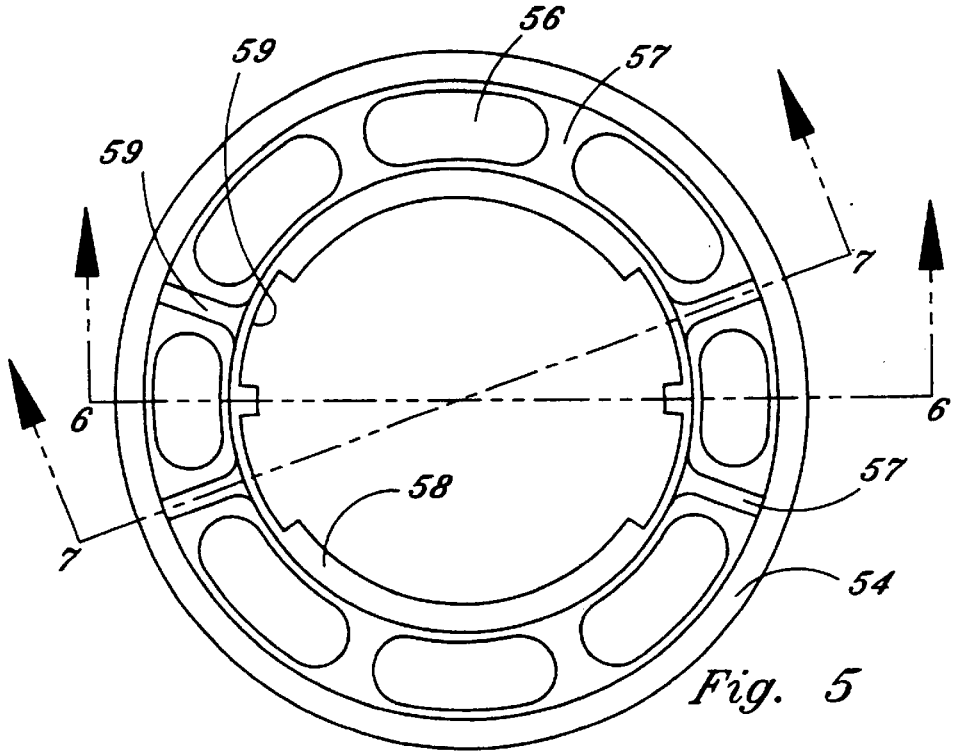
FIG. 5 is a top planar view of the voice coil adaptor ring of the instant invention.
Figure 6:
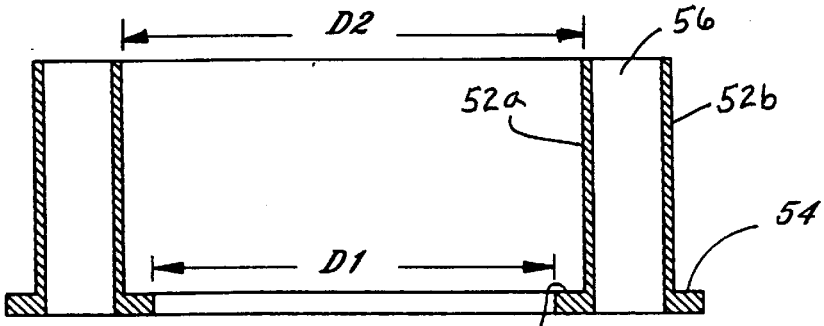
FIG. 6 is a cross-sectional view of the voice coil adaptor ring of the instant invention taken along line 6—6 of FIG. 5.
Figure 9:
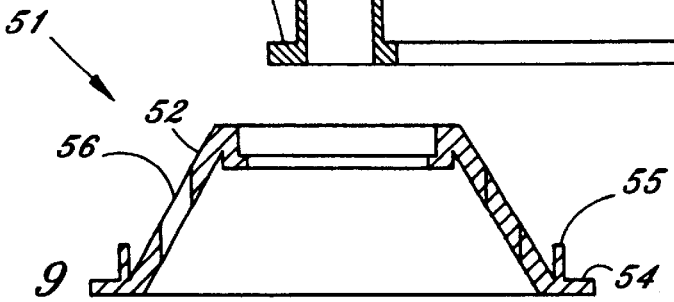
FIG. 9 is a cross-section view of another embodiment of the adaptor ring of the instant invention.

Referring now to FIGS. 2–9, one preferred embodiment of this invention is illustrated in which a loudspeaker 50 incorporates an adaptor ring 51. The adaptor ring 51 comprises a substantially cylindrical-shaped wall 52 having an inner surface 52*a* adapted for snugly mating and conforming to the outer peripheral edges of the voice coil former 43, and an outer surface 52*b* spaced from the inner surface 52*a*. With reference to FIG. 9, the adaptor ring in the alternative may comprise other shapes, such as conical, without departing from the scope and spirit of the instant invention. As seen in FIG. 6, the wall 52 of adaptor ring 51 has a radially inwardly extending glue flange 58 which defines a first inner diameter D1 corresponding to the outer diameter of the voice coil former 43. A second inner diameter, D2, is defined by the inner surface 52*a* of the adaptor wall 52. Thus, a gap exists between the interior wall 52*a* and the outer surface of voice coil former 43 when the ring 51 is installed since the glue flange 58 engages the outer surface of the former 43. This gap is filled with epoxy 60 to secure the adaptor ring 51 to the voice coil former 43. See FIG. 1A. Since the ring 51 inner diameter mounts over the voice coil former 43, an inherent gap is still present for adhesives without the inner flange 58. Adhesive adheres the ring 51 to the former 43.

In the alternative, the former 43 may be manufactured with a projecting shelf on which the adaptor ring would sit and lock in place. In this alternative embodiment, the inner glue flange 58 would define grooves 59 which would interlock with the projecting shelf where the adaptor ring is rotated, locking it in place.

The adaptor ring 51 further comprises venting passages 56 which extend vertically through the cylindrical wall 52 between its inner and outer surfaces 52*a* and 52*b*, to provide a passageway for venting air from the dust cap cavity 48 of the speaker. The venting passages 56 prevent pressure build up in the dust cap cavity 48 for improved sound quality.

Figure 2:
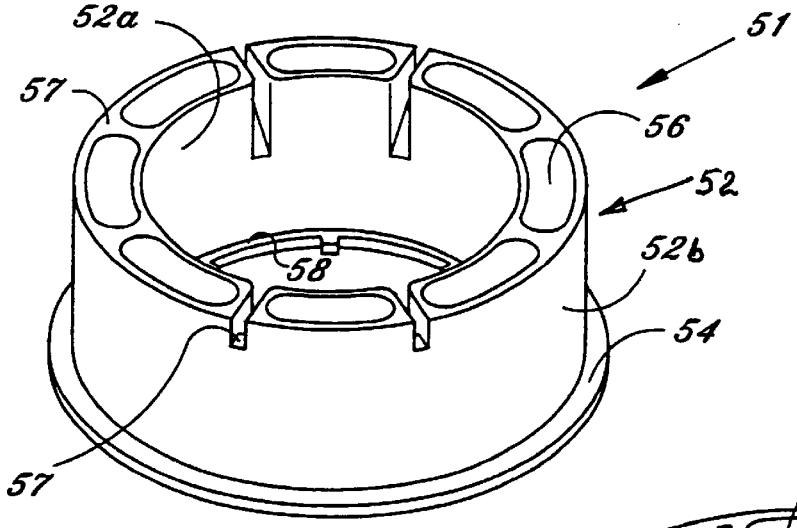
FIG. 2 is a top perspective view of the preferred embodiment of the voice coil adaptor of the instant invention.
Figure 3:
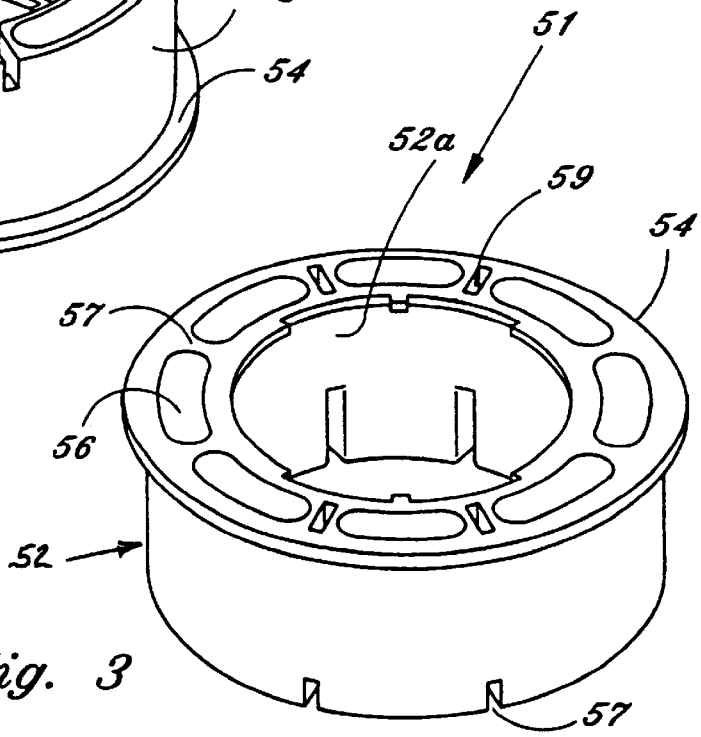
FIG. 3 is a bottom perspective view of the voice coil adaptor of the instant invention.
Figure 7:
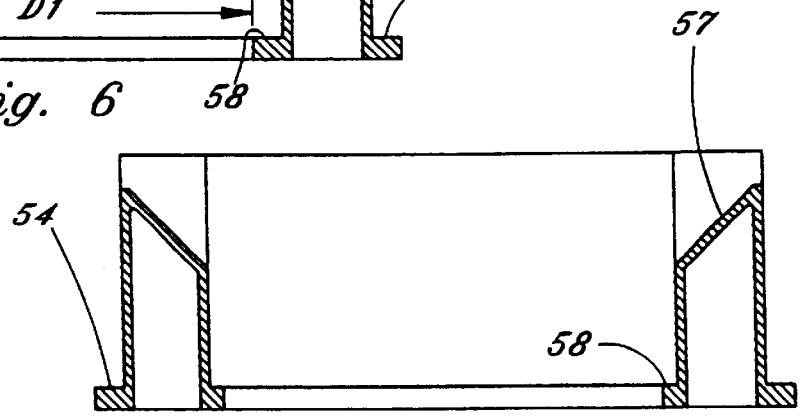
FIG. 7 is a cross-sectional view of an embodiment of the voice coil adaptor ring taken along line 7—7 of FIG. 5.

With reference to FIGS. 6–7, a cross-section of the adaptor ring is shown to illustrate the venting passages 56 and the inner glue flange 58. The passages 56 are divided by partitions 57. The partitions 57 may be sloped, tapered, planar or otherwise. Selected partitions 57 may be sloped, as shown in FIG. 7, to reduce stress on lead out wires when they are run through the adaptor 51. Lead out wires are typically fragile, so bending the wires at right angles would increase the risk of fractures. As best seen in FIGS. 2, 3 and 5, the adaptor ring 51 includes a means for running lead out wires. This wire running means preferably comprises slots 59 formed at selected locations around the inner peripheral edge of the inner glue flange 58 so that wire running channels are formed when the adaptor ring 51 is mounted to the voice coil former 43. The slots 59 are preferably in alignment with the sloped partitions 57 so that lead out wires may be passed through the wire channels and over the sloped partitions. In the alternative, wire channels may be bored through the adaptor ring wall 52, plateau 54 or inner glue flange 58. The adaptor ring 51 may be manufactured by any plastic, thermoplastic, polymer plastic, metal or other acceptable material. An injection molding process is preferred to make the ring 51. It should be noted, however, that any embodiment of the adaptor ring may be manufactured integrally with the voice coil former 43 such that the adaptor ring would be metallic.

The venting passages 56 eliminate the need for a pole vent 42, such as shown in FIG. 1. The conventional pole vent 42 is required in the background art to vent heat and air pressure build up in the cone volume, as defined by the dust cap cavity 48. The voice coil adaptor ring 51 of the instant invention eliminates the pole vent 42 by including venting passages 56 in the adaptor ring 51, as discussed above. Replacing the conventional pole vent 42 with the adaptor ring vent passages 56 saves machining in the pole piece structure 41 so as to reduce costs. A solid pole piece 41 also increases magnetic circuit efficiency and provides an improved thermal path for heat transfer from the voice coil. By allowing for improved heat transfer from the voice coil, the driver may be operated at a higher power rating.

With reference to FIGS. 2–8, the cylindrical-shaped wall 52 of the adaptor ring 51 is preferably formed with at least one spider plateau 54 which extends radially outwardly from its outer surface. The spider plateau 54 is preferably planar, or substantially horizontal, such that it provides a ledge for receiving and securing the spider 38 and the lower end of the diaphragm 24. The spider plateau 54 preferably supports the inner edge of the spider 38 and provides enough surface area for applying adhesives between the spider 38 and the ledge 54 so as to firmly secure the spider 38 in place. Adhesives may also be applied to the upper surface of the spider 38 for adhering the neck of the cone 24. The ledge 54 of the adaptor ring 51 provides a more stable securing structure than the cylindrical, outer surface of the voice coil former 43, to which the spider 38 and diaphragm 24 are conventionally mounted in the prior art. In addition, the ledge 54 provides a structure that enables the joining of the diaphragm 24 and spider 38 for a stronger joint. Accordingly, attaching the spider 38 and diaphragm 24 to the voice coil adaptor ring 51 along a larger circumferential planar surface provides more contact area for applying epoxy. This additional contact area alleviates stress on the glue joints via improved stress distribution for increased reliability. Additionally, the surface of the spider plateau 54 and/or the entire adaptor ring 51, can be textured or ribbed to enhance adhesion. The adaptor ring 51 and spider plateau 54 also provide a mechanical stop for the lower end of the diaphragm 24 providing a more reliable joint. Once the diaphragm 24 is attached to the top of the spider 38, the spider 38 is completely locked in place.

Referring to FIG. 4, the voice coil adaptor ring 51 provides extra coil attachment height allowing for a larger adhesive contact area, especially in small diameter voice coils. In addition, an inner glue flange 58 may aid in the gluing process by catching and holding the glue in contact with the coil former surface allowing a larger amount of adhesive to be used. This large joint provides a more favorable stress distribution around the voice coil former 43 making the attachment more reliable.

Figure 8:
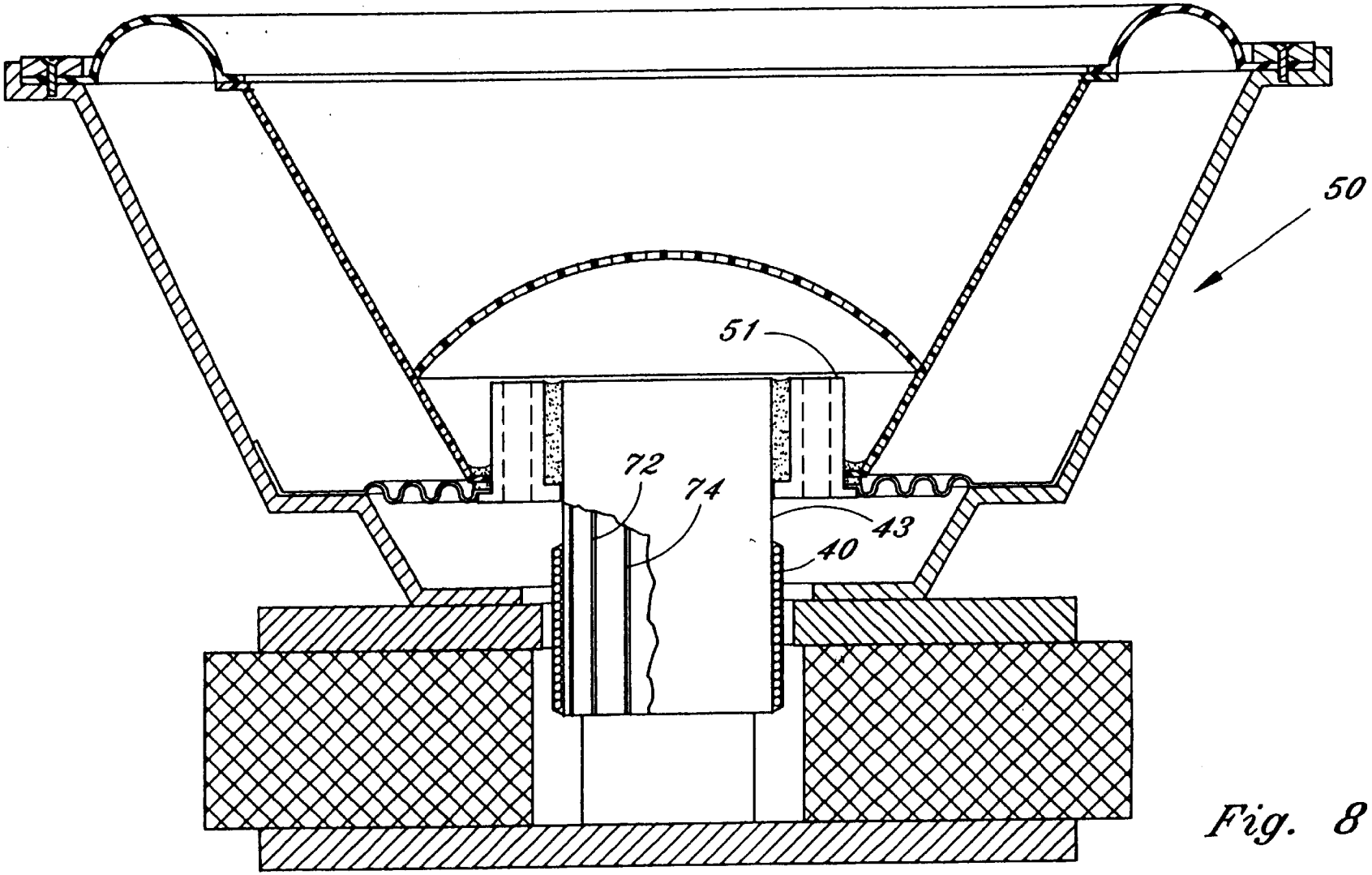
FIG. 8 is a cross-sectional view of another embodiment of the loudspeaker of the instant invention with a partial cutout in the voice coil former to illustrate grooves on the inner surface of the voice coil former when the former and adaptor ring assembly are manufactured from a conductive material.

With reference to FIG. 8, the voice coil former 43 may have grooves 72 and 74 formed along the interior wall, preferably from top to bottom. The grooves 72 and 74 provide a means for breaking any conductive loop in the former 43 that may result. These grooves 72, 74 may be especially necessary when the adaptor ring 51 is formed integrally with the former 43 and the former-adaptor ring assembly is electrically conductive. An alternative embodiment of the adaptor ring is shown in FIG. 9, where the adaptor 51 is conical in shape. The conical adaptor 51 includes a spider plateau 54, a sloped wall 52, and vent passages 56. A vertical stop 55 is also included in this alternative embodiment for receiving the diaphragm 24 and spider 38, and facilitating an improved adhesion surface.

Referring now to FIGS. 10–17, alternative embodiments of this invention are illustrated in which the functionality of the adaptor 51 described above with reference to FIGS. 1–10 is maintained, but the adaptor 51 is eliminated in favor of different configurations of the lower end of the diaphragm 24.

Referring initially to FIGS. 10–14, a loudspeaker 90 is illustrated which includes a diaphragm 24 preferably formed with an upper end 100 connected to the surround or upper suspension 28 and a cylindrical-shaped lower end 102. In FIGS. 10 and 11, the lower end 102 of diaphragm 24 includes an inner surface 104, an outer surface 106 spaced from the inner surface 104 and a number of circumferentially-spaced vent bores or slots 108 formed between the inner and outer surfaces 104, 106. The vent bores 108 extend from the top edge 110 of the lower end 102 of diaphragm 24 to its bottom edge 112, as seen in FIG. 10. For purposes of the present discussion, the terms "upper" or "top" refer to the vertically upward direction with the loudspeaker 90 oriented in the position shown in FIG. 10, while the terms "lower" or "bottom" refer to the opposite direction. The term "inner" refers to a direction or location toward the longitudinal axis of the voice coil 40, whereas "outer" refers to the direction radially outwardly from the voice coil 40 as it is depicted in FIG. 10.

In the embodiment of FIGS. 10 and 11, the inner surface 104 of the lower end 102 of diaphragm 24 is affixed directly to the outer surface of the voice coil former 43 by adhesive or other suitable means. The lower suspension or spider 38 is connected by adhesive or the like to the outer surface 106 of the lower end 102 of diaphragm 24. In the alternative embodiment of this invention shown in FIG. 12, the lower end 102 of the diaphragm is similar to that depicted in FIGS. 10 and 11, except that a spider plateau 114 extends outwardly from the outer surface 106 for mounting the inner end of the spider 38.

Figure 13:
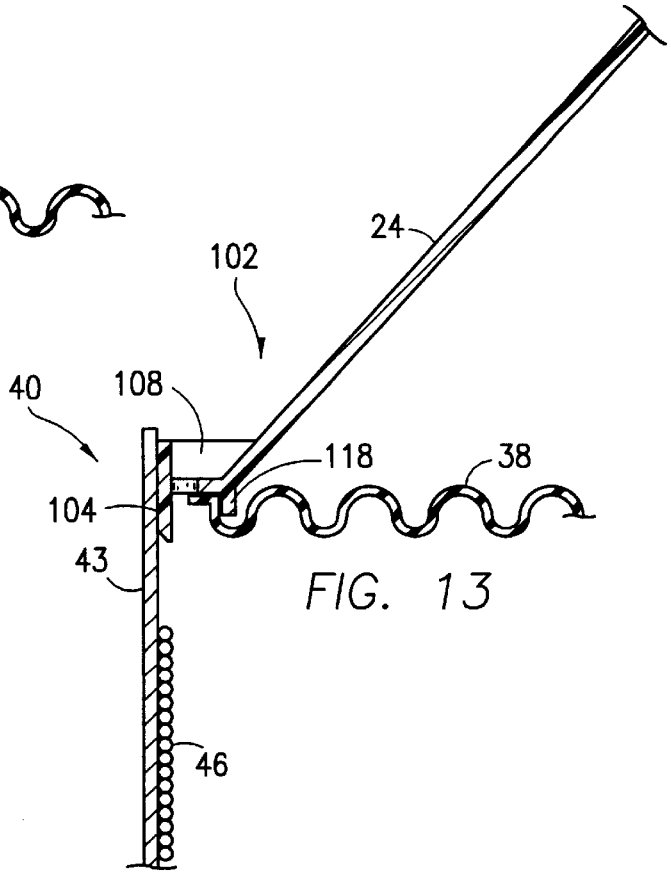
FIG. 13 is a view similar to FIG. 11, except of a different embodiment of the lower end of the diaphragm.

Alternatively, as shown in FIG. 13, the lower end 102 of the diaphragm 24 is formed with an outer surface which defines an inverted, generally L-shaped seat 118 defined by perpendicular legs within which the inner end of spider 38 is mounted by adhesive or the like. The seat 118 forms an adhesive "well" or cavity to receive the spider 38 and reduce stress on its inner end, particularly during high excursions of the voice coil 40 resulting from operation of the speaker 90.

Figure 14:
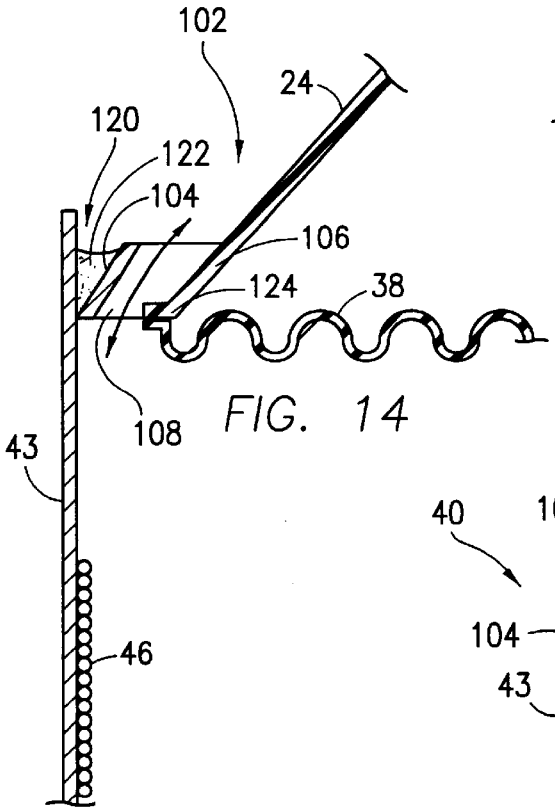
FIG. 14 is a view similar to FIG. 11, except of a still further embodiment of the lower end of the diaphragm.

A still further embodiment of the lowermost end 102 of diaphragm 24 is depicted in FIG. 14, wherein the inner surface 104 is oriented at an angle with respect to the outer surface of the voice coil former 43 thus forming a pocket or well 120. Adhesive 122 is placed within the well 120 to secure the diaphragm 24 to the former 43. The outer surface 106 of the lower end 102 of diaphragm has an extended, generally planar section 124 forming a plateau or ledge for mounting the inner end of spider 38.

Figure 12:
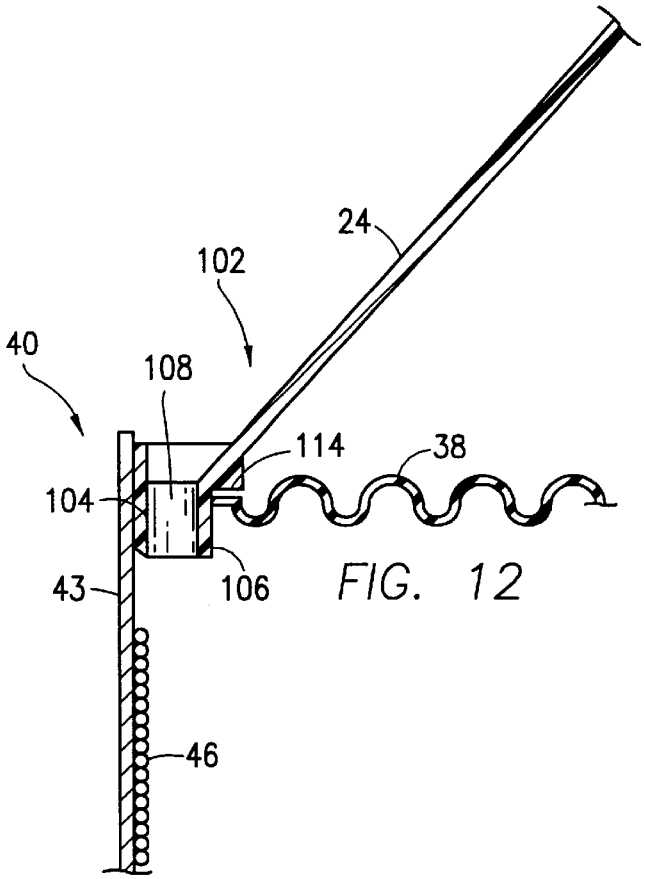
FIG. 12 is a view of an alternative construction of the lower end of the diaphragm depicting its connection to the voice coil former and spider.

In each of the embodiments shown in FIGS. 10–14, the adaptor 51 of the previous embodiments is eliminated in favor of the formation of the lower end 102 of diaphragm 24 with a number of circumferentially-spaced vent bores 108 which function to relieve pressure within the dust cap cavity 48. FIGS. 12–14 further include a plateau or seat for mounting the inner end of spider 38. This construction of the lower end 102 of diaphragm 24 reduces the mass in the area of the voice coil 40, which, as noted above, is particularly advantageous in smaller, midrange speakers and small mid-bass woofers.

Figure 16:
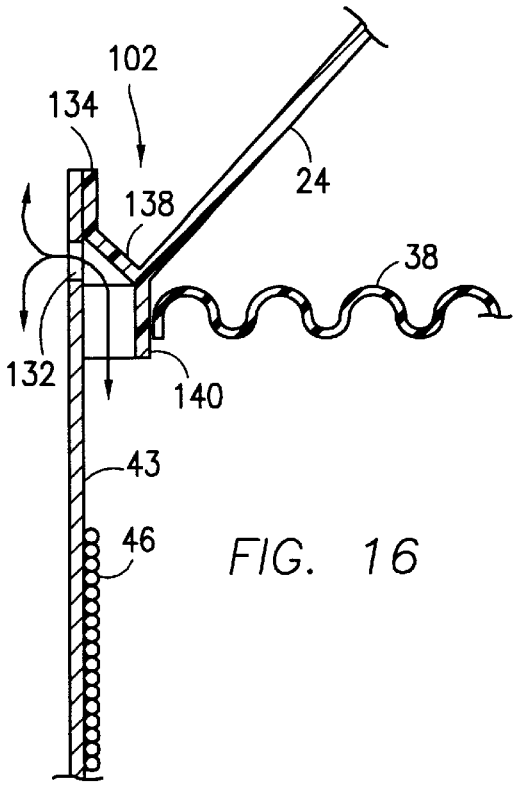
FIG. 16 is a partial view of the loudspeaker shown in FIG. 15 depicting an alternative embodiment of the lower end of the diaphragm.
Figure 17:
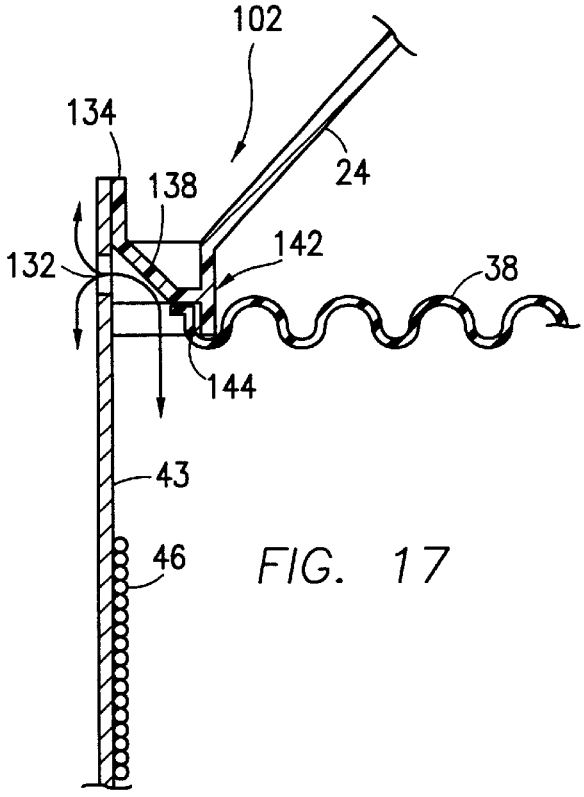
FIG. 17 is a view similar to FIG. 16 except of a further embodiment of the lower end of the diaphragm.

The embodiments of this invention shown in FIGS. 15–17 provide the same advantages over the use of an adaptor 51 described in connection with a discussion of FIGS. 10–14, with the addition of structure for obtaining at least some cooling of the voice coil 40. Referring initially to FIG. 15, a loudspeaker 130 is illustrated which is essentially the same as loudspeaker 90 except the former 43 of the voice coil 40 is formed with a number of spaced vent bores 132 near its upper end. The diaphragm 24 has a lower end 102 which includes an upper leg 134 mounted by adhesive or the like to the outer surface of the former 43, a generally U-shaped lower leg 136 and a tapered deflector 138 connected between the upper and lower legs 134, 136. The base of the lower leg 136 forms a ledge of plateau for mounting the inner end of spider 38.

A variation of the construction of the lower end 102 of diaphragm 24 is shown in FIG. 16. In this embodiment, the same upper leg 134 and deflector 138 of FIG. 15 are employed but an essentially vertically extending lower leg 140 is provided instead of the U-shaped lower leg 136 of FIG. 15. As such, the spider 38 is connected by adhesive or the like to the side of the lower leg 140 in the position shown in FIG. 16. The embodiment of FIG. 17 depicts a still further embodiment of the lower end 102 of diaphragm 24 having the same upper leg 134 and deflector 138 construction as previously described, but with the addition of a lower leg 142 formed with an inverted, L-shaped seat 144 similar to the seat 118 described above in connection with a discussion of FIG. 13. The inner end of spider 38 is mounted to seat 144 in the same manner as seat 118 noted above.

In response to axial movement of the voice coil 40, a pumping action is created by the diaphragm 24 and dust cap 26 which induces a flow of air into and out of the dust cap cavity 48 through the vent bores 132 in the former 43. At least some ambient air is drawn from outside of the loudspeaker 130 into the dust cap cavity 48 by the pumping action of the diaphragm 24, which is much cooler than the air within the interior of the loudspeaker 130 due to the heat generated by the voice coil 40 and top plate 37 of the motor structure 21. This flow of air enters and exits the dust cap cavity 48 via the vent bores 132 in the former 43, which function to prevent the build up of air pressure within the cavity 48. In order to take full advantage of the movement of ambient air in and out of the vent bores 132, the lower end 102 of the diaphragm in each of the embodiments depicted in FIGS. 15–17 is mounted to the former 43 of the voice coil 40 so that the deflector 138 is positioned generally in alignment with the vent bores 132 in the former 43. The deflector 138 is effective to contact and re-direct the flow of air through the vent bores 132 in a direction toward the wire winding 46 on the outer surface of the former 43 and the top plate 37 of the motor structure 21. This air flow provides at least some cooling of these elements, thus improving the power handling of the loudspeaker 130.

While the invention has been described with reference to a preferred embodiment, it should be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that he invention not be limited to the particular embodiment disclosed as the best mode contemplated for carrying out the invention, but that the invention will include all embodiments falling within the scope of the appended claims.

What is claim is:

1. A loudspeaker, comprising:

a motor structure with a movable voice coil, said voice coil including a former having a hollow interior and an outer surface which mounts a wire winding;

a frame having an upper end and a lower end, said lower end being connected to said motor structure;

an upper suspension connected to said upper end of said frame;

a diaphragm having an upper end connected to said upper suspension and a lower end, said lower end of said diaphragm being formed with an inner surface, an outer surface spaced from said inner surface and a number of spaced vent bores located between said inner and outer surfaces, said inner surface of said lower end of said diaphragm being connected to said voice coil, a cavity being formed in an area at least partially defined by said diaphragm and said voice coil; and a lower suspension connected at one end to said frame and at the other end to said lower end of said diaphragm.

2. The loudspeaker of claim 1 in which said inner and outer surfaces of said lower end of said diaphragm terminate at a top edge and a bottom edge, said vent bores extending between said top and bottom edges.

3. The loudspeaker of claim 1 in which said lower end of said diaphragm is substantially cylindrical in shape, said vent bores being circumferentially spaced from one another between said inner and outer surfaces of said lower end of said diaphragm.

4. The loudspeaker of claim 1 in which said lower end of said diaphragm is formed with a plateau, said other end of said lower suspension being connected to said plateau.

5. The loudspeaker of claim 1 in which said lower end of said diaphragm is formed with a seat having a first leg and a second leg oriented generally perpendicular to said first leg, said other end of said lower suspension being mounted within said seat.

6. The loudspeaker of claim 1 in which said inner wall of said lower end of said diaphragm is mounted at an angle to said voice coil former thus forming a space therebetween for the receipt of adhesive.

7. A loudspeaker, comprising:

a motor structure with a movable voice coil, said movable coil including a former having a wall defining a hollow interior and an outer surface which mounts a wire winding, said wall being formed with a number of vent bores;

a frame having an upper end and a lower end, said lower end being connected to said motor structure;

an upper suspension connected to said upper end of said frame;

a diaphragm having an upper end connected to said upper suspension and a lower end connected to said voice coil, a cavity being formed in an area at least partially defined by said diaphragm and said voice coil;

a lower suspension connected at one end to said frame and at the other end to said lower end of said diaphragm;

a flow of air in and out of said cavity and through said vent bores in said former being created in response to movement of said voice coil, said lower end of said diaphragm being formed with a deflector located in the path of said air flow which is effective to direct said air flow toward said wire winding on said outer surface of said former.

8. The loudspeaker of claim 7 in which said lower end of said diaphragm is formed with an upper leg connected to said former of said voice coil and a lower leg connected to said spider, said deflector being connected between said upper and lower legs.

9. The loudspeaker of claim 8 in which said lower leg is formed with a seat within which said lower suspension is mounted.

10. The loudspeaker of claim 8 in which said lower leg is formed with a plateau along which said lower suspension is mounted.

* * * * *